US010066426B2

(12) United States Patent
Hunt et al.

(10) Patent No.: US 10,066,426 B2
(45) Date of Patent: Sep. 4, 2018

(54) MOTOR VEHICLE DOOR LATCH

(71) Applicant: Kiekert AG, Heiligenhaus (DE)

(72) Inventors: Robert J. Hunt, Davisburg, MI (US); William E. Burger, Howell, MI (US)

(73) Assignee: Kiekert AG, Heiligenhaus (DE)

( * ) Notice: Subject to any disclaimer, the term of this patent is extended or adjusted under 35 U.S.C. 154(b) by 7 days.

(21) Appl. No.: 15/422,624

(22) Filed: Feb. 2, 2017

(65) Prior Publication Data

US 2018/0216374 A1 Aug. 2, 2018

(51) Int. Cl.

| | |
|---|---|
| ***E05B 85/26*** | (2014.01) |
| ***E05B 81/14*** | (2014.01) |
| *E05B 15/04* | (2006.01) |

(52) U.S. Cl.

CPC ..... *E05B 85/26* (2013.01); *E05B 81/15* (2013.01); *E05B 2015/042* (2013.01); *E05B 2015/0427* (2013.01)

(58) Field of Classification Search

CPC ..... E05B 85/26

See application file for complete search history.

(56) References Cited

U.S. PATENT DOCUMENTS

2016/0265255 A1* 9/2016 Mazal ..... E05B 83/18

FOREIGN PATENT DOCUMENTS

| | | |
|---|---|---|
| DE | 10 2006 012 105 A1 | 9/2007 |
| GB | 2 457 680 A | 8/2009 |

* cited by examiner

*Primary Examiner* — Kristina R Fulton
*Assistant Examiner* — Thomas L Neubauer
(74) *Attorney, Agent, or Firm* — Renner, Otto, Boisselle & Sklar, LLP

(57) ABSTRACT

The object of the present invention is a motor vehicle door latch which is equipped with a locking mechanism (2, 3) predominantly consisting of a catch (2) and a pawl (3). Furthermore, a spring-impinged storage element (8) is provided for which maintains the pawl (3) in an elevated storage position during an opening process of the locking mechanism (2, 3) until the catch (2) is opened. According to the invention, the spring-impinged storage element (8) is formed as a leg spring (8) which is anchored in the latch with its one leg (8*b*) and with its other leg (8*a*) in the storage position maintains the pawl (3) in the elevated position and is braced on the catch (2) to this end.

14 Claims, 6 Drawing Sheets

MOTOR VEHICLE DOOR LATCH

Figure 1:
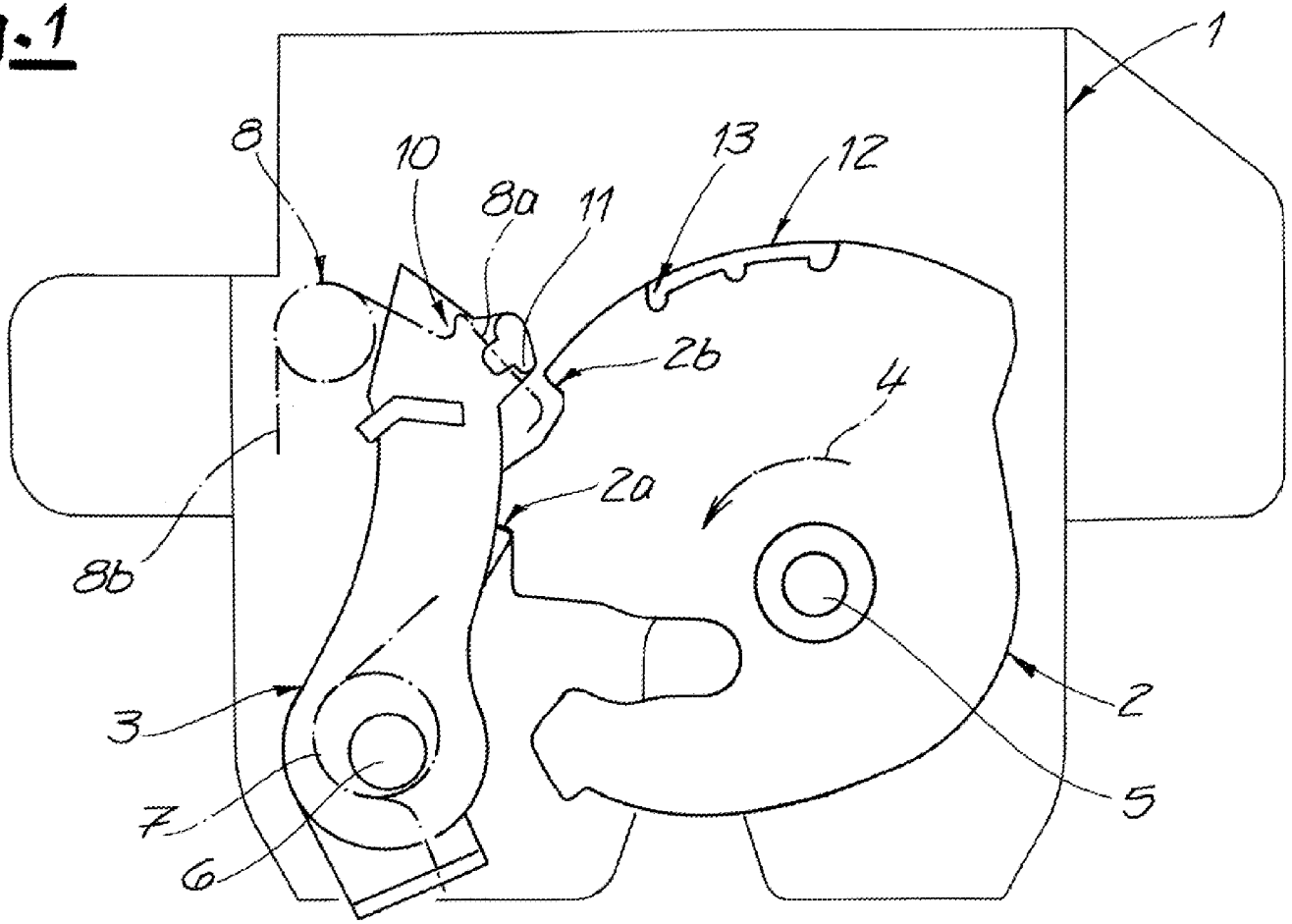
Figure 2:
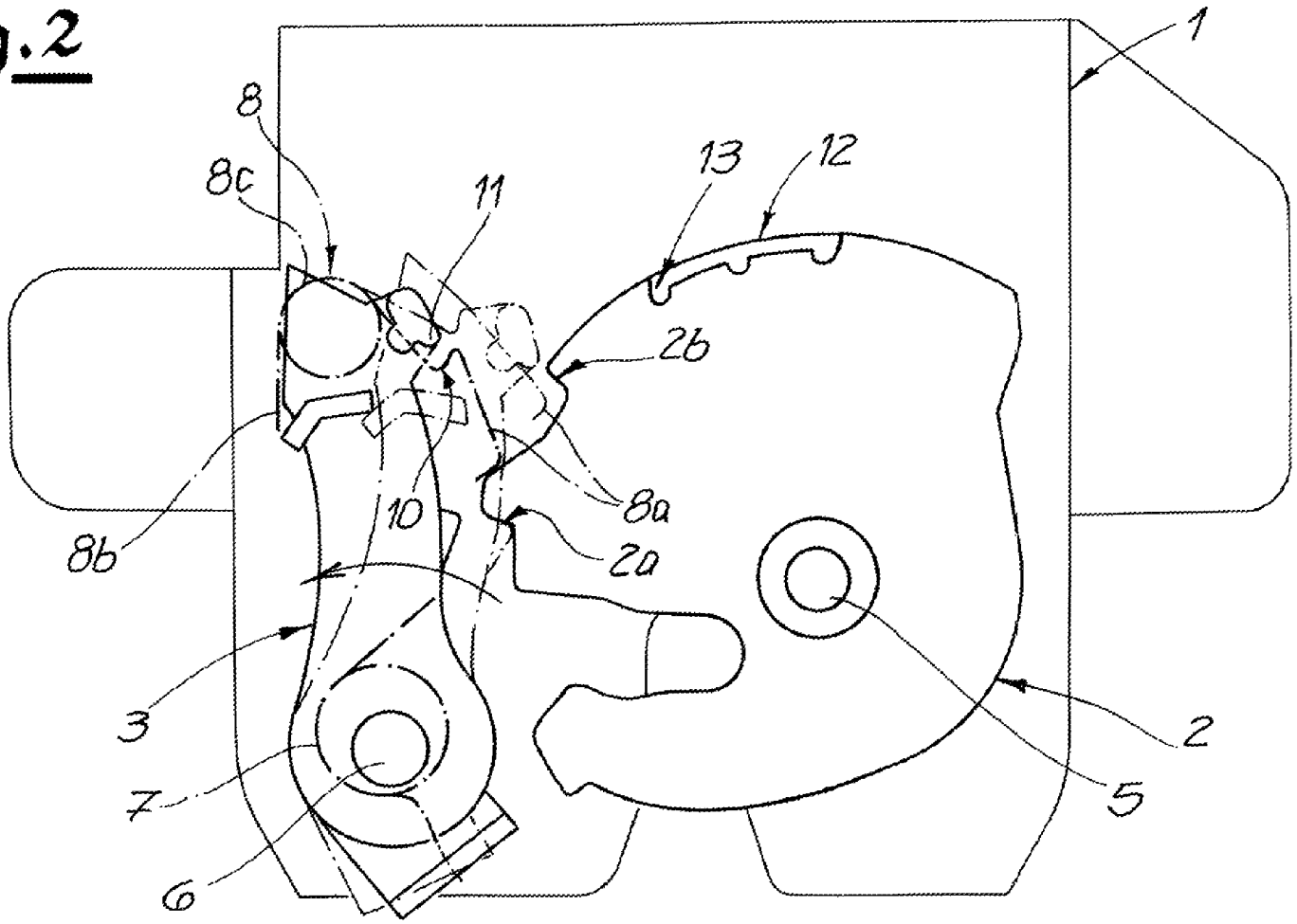

The invention relates to a motor vehicle door latch, with a locking mechanism fundamentally comprising a catch and a pawl, and with a spring-impinged storage element which maintains the pawl in its elevated storage position during an opening process until the catch is opened.

For motor vehicle door latches and in particular tailgate latches or front flap latches, in practice the pawl lifted from the catch to open the locking mechanism sometimes encounters the catch still in the closed position after ending of the impingement. Such functional states are observed, for example, when the tailgate or front flap does not or is unable to shift into its open position due to frost or other circumstances, despite the locking mechanism being open. In order to finally open the relevant flap, it is consequently necessary to once again lift the pawl from the catch.

Such a repeat opening process is already prevented in the state of the art. Because the storage element is provided to this end which maintains the pawl in the storage position during an opening process of the locking mechanism. This position of the pawl in the storage position is maintained until the catch is (completely) opened.

Thus, for example, the pawl can also be prevented from (re)engaging into a ratchet of the catch with remote control and incomplete opening of the pertaining motor vehicle door. This applies both when the opening process is automatic and also when opening takes place manually.

In the class-specific state of the art according to DE 10 2006 012 105 A1 a storage element is executed which is impinged with the aid of a spring. The storage element is maintained adjacent to at least one latch component with the aid of the relevant spring during opening of the pertaining locking mechanism. Functional safety, in particular with regard to the storage element, is thus increased. A structurally simple design is also described.

In GB 2 457 680 A a spring is provided which works on a triggering lever. The spring prevents the triggering lever being pivoted into a first position. Although the spring is executed as a storage element here so to speak, it acts on the triggering lever and not on the pawl.

The invention is based on the technical problem of further developing a motor vehicle door latch of the construction initially described in such a way that the effort involved in construction and consequently the costs are reduced with unchanged functional safety.

In order to solve this technical problem, a class-specific motor vehicle door latch within the scope of the invention is characterized in that the spring-impinged storage element is designed as a leg spring which is anchored in the latch housing with one leg and maintains the pawl in the elevated position with its other leg in the storage position and is braced on the catch to this end.

Within the scope of the invention, the spring-impinged storage element is condensed in one component so to speak, namely in the leg spring. The leg spring has two legs and a wound central section to which the legs are connected. One leg is anchored in the latch housing. This is usually a housing leg. The other leg of the leg spring maintains the pawl in the storage position. To this end, the other leg is braced on the catch. Consequently, this is the so-called latch leg.

According to an advantageous design, the housing leg and the latch leg encompass a particularly acute angle between themselves. Furthermore, both legs regularly originate from the wound central section and are connected to it, generally tangentially. This means that both the housing leg and the latch leg originate tangentially from the wound central section, which usually describes a circular area. The housing leg and the latch leg generally encompass an acute angle between themselves.

Thus, the leg spring formed as a spring-impinged storage element can not only maintain the pawl elevated from the catch in its storage position according to the invention as long as the catch is not yet open; but the design with recourse to the two legs also enables a spring force to be accumulated which acts in the direction of an open position of both legs. As a consequence hereof, the leg spring assumes the functions typically separate from one another in the state of the art, namely on the one hand the function of the spring and on the other hand the function of the storage element and condenses this into a single component, namely the leg spring. This results in constructional and cost-related advantages compared to the previous procedure.

To this end, the latch leg is equipped with a stop which maintains the pawl in its storage position. Furthermore, the pawl typically possesses a protrusion which is set up and configured to interact with the relevant stop.

Thus, the leg spring assumes a further function; it namely forms the stop maintaining the pawl in its storage position. In the process, the pawl in turn interacts with a protrusion with the stated stop.

In detail, the configuration in this context is such that the relevant protrusion on the pawl during the opening process of the locking mechanism glides along the latch leg and overlaps the stop. As soon as the catch is not completely opened during this opening process or the opening process as a whole is interrupted, the protrusion is held on the pawl by the stop and also the pawl overall. Thus, the pawl can no (longer) be pivoted back into a ratchet position interacting with the catch. A pawl spring additionally engaging on the pawl ensures this in general. Now the pawl is in the storage position.

This functional state is maintained until the catch assumes its closed position or the opening process is interrupted. The storage position of the pawl is only cancelled when the opening process of the locking mechanism is resumed and the catch is usually completely opened. To this end, the catch is advantageously equipped with a contour to cancel the storage position. The contour is advantageously arranged on an edge of the catch, namely on the edge of the catch facing the pawl. In detail, the contour possesses a stop.

As soon as the catch now pivots into its open position, the relevant contour or the stop provided now becomes adjacent to the latch leg of the leg and ensures that the relevant latch leg is shifted out of the pawl protrusion. Thus, the leg spring is compressed overall with the aid of the stop or the contour because the latch leg is pivoted with the aid of the contour away from the pawl protrusion. At this time, the latch leg leaves the pawl protrusion in such a way that the storage position of the pawl is lifted. Because due to the impingement of the latch leg with the aid of the contour or the stop the latch leg or the stop is elevated from the protrusion of the pawl on the latch leg.

As a consequence hereof, the pawl can no longer be braced on the catch, but its external surface is adjacent to the opening catch. As this adjacency is on the other side of the ratchet recesses of the catch, the catch can easily open completely. An additionally provided catch spring which pretensions the catch in an open position aids this in conjunction with the exiting of the striker. This means that the contour for the cancellation of the storage position simultaneously also lifts the stop on the latch leg from the protrusion on the pawl. Because in the cancellation of the storage position the latch leg is moved on the catch in the direction of the housing leg against the accumulating spring tension with the aid of the contour.

As a result, a motor vehicle door latch is provided which is suited in particular but not exclusively for execution of a hood latch or a flap latch. For this purpose, the motor vehicle door latch according to the invention possesses a spring-impinged storage element which, according to the invention, involves a leg spring with the housing leg attached to the housing and the latch leg bracing on the catch. The housing leg is anchored or fixed in the latch housing. In contrast, the latch leg can move in relation to the housing leg and in particular the angle encompassed between the two legs, which is typically acute, can be changed by relevant impingement of the latch leg.

In conjunction with the fact that the stop for the protrusion on the pawl is simultaneously provided for on the latch leg, with the aid of which the pawl is maintained in the storage position, an especially simple and cost-effective variant of the spring-impinged storage element is executed overall. These are the crucial advantages.

Hereinafter, the invention is explained in further detail on the basis of a sketch which only depicts an execution example.

FIG. 1 to 6 show the motor vehicle door latch according to the invention in different functional positions.

The figures depict a motor vehicle door latch which is equipped with a latch case 1 and a pivotably stored locking mechanism 2, 3 in the latch case 1. The locking mechanism 2, 3 comprises a catch 2 and a pawl 3 interacting with it. The catch 2 is pivotably located around an axis 5 in the latch case 1. In contrast, the pawl 3 is pivoted around a rotational axis 6.

The catch 2 is assigned to an only depicted catch spring 4 which pre-tensions the catch 2 in the direction of its open position. This is shown by an arrow in FIG. 1 which corresponds to an anti-clockwise direction movement of the catch 2 around its axis 5 during an opening process. In fact, FIG. 1 shows the locking mechanism 2, 3 in its closed position or in a main ratchet position. In this main ratchet position, the pawl 3 engages into a main ratchet recess 2*a* braced by a pawl spring 7. Furthermore, the catch 2 may possess a further ratchet recess, namely the secondary recess 2*b* if dictated by customer or regulation.

A spring-impinged storage element 8 is of particular importance for the invention now which involves a leg spring 8 according to the invention. The storage element 8 ensures that the pawl 3 is maintained in the elevated storage position until the catch 2 is opened beyond any ratchet positions (2*a* 2*b*) in an opening process of the locking mechanism 2, 3. The relevant storage position is depicted in FIG. 3.

The spring-impinged storage element 8 or the leg spring 8 possesses a leg 8*b* which is braced against a stationary feature in this example a latch housing. The relevant leg 8*b* is consequently a housing leg 8*b*. The latch housing is not explicitly shown in the illustrations because it extends upwards in the top view over the latch case 1 so to speak. However, the relevant leg 8*b* is anchored, it is not explicitly depicted.

The leg spring 8 possesses a further moving leg 8*a* in addition to the one stationary leg 8*b*. The leg 8*a* is a latch leg 8*a*. The leg spring 8 maintains the pawl 3 in the storage position with the other leg or latch leg 8*a*. The storage position of the pawl 3 corresponds to the elevated position of the pawl 3 as depicted in FIG. 3. To this end, the relevant leg or latch leg 8*a* is not engaged by the contour 12 on the catch 2. In the same way as the pawl 3, the entire locking mechanism 2, 3 is naturally in the storage position within the scope of the illustration according to FIG. 3.

Figure 3:
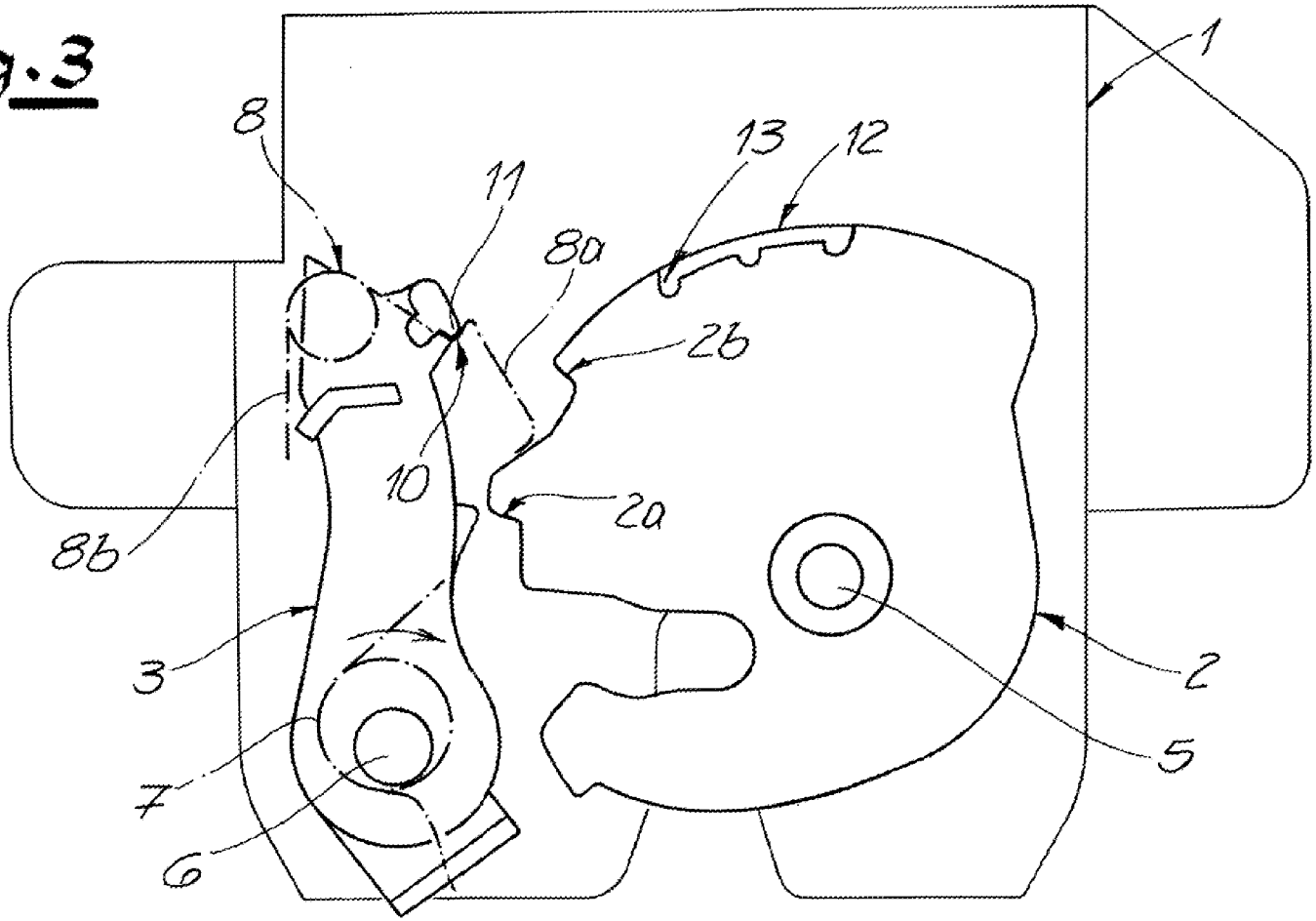

As already explained, the latch leg 8*a* engages the pawl protrusion 11 when not impeded by the contour 12 of the catch 2 in the storage position of the pawl 3 according to the illustration in FIG. 3. In the execution example, the relevant contour end 13 is arranged in the catch 2 beyond any ratchet recess 2*a* or pre-ratchet recess 2*b*. Thus, the leg or the latch leg 8*a* can be directly engaged in the pawl protrusion 11 in case the catch 2 predominantly maintains its closed position according to FIG. 1 maintaining the elevated position of the pawl 3 from the catch 2 until an opening of the locking mechanism 2, 3. The opening movement of the catch 2 in an anti-clockwise direction in relation to its axis 5 already spoken about in reference to FIG. 1 and depicted by the arrow there corresponds to this as is known.

The latch leg 8*a* is equipped with a stop 10. The stop 10 on or in the latch leg 8*a* of the leg spring 8 interacts with a protrusion 11 on the pawl 3. The stop 10 in or on the latch leg 8*a* is a Z-shaped connection or a Z-shaped characteristic of the otherwise straight latch leg 8*a* within the scope of the execution example. However, the stop 10 in or on the latch leg 8*a* ensures that the pawl 3 is maintained in its storage position according to FIG. 3. Because in this storage position the relevant stop 10 interacts with the protrusion 11 on the pawl 3.

Despite the spring forces accumulated by the pawl spring 7 on the pawl 3 which pre-tension it in the direction of its adjacency to the catch 2, i.e. which correspond to a clockwise direction movement depicted in FIG. 3 around the rotational axis 6, in the storage position according to FIG. 3 the pawl 3 is consequently unable to interact in a ratchet-like manner with the catch 2. Because the pawl 3 is maintained in its storage position and in an elevated position in relation to the catch 2 with the aid of the leg spring 8.

During an opening process of the locking mechanism 2, 3 the protrusion 11 glides along the latch leg 8*a* and overlaps the stop 10. This is apparent in the transition from FIG. 1 to FIG. 2 or on the basis of the two positions of the pawl 3 depicted in FIG. 2. In fact, the opening process of the locking mechanism 2, 3 corresponds to the pawl 3 being elevated from the catch 2, for example with the aid of a triggering lever engaging on it. To this end, the pawl 3 is pivoted around its axis 6 with the aid of the triggering lever along the arrow depicted in FIG. 2 in an anti-clockwise direction. The pawl 3 is thus lifted from the catch 2. In this process, the protrusion 11 on the pawl 3 glides along the latch leg 8*a* and overlaps the relevant stop 10 in the elevated position of the pawl 3. As soon as the triggering lever no longer impinges the pawl 3 in the example, the pawl 3 moves—impinged by the pawl spring 7—slightly in a clockwise direction back around its axis 6, until the protrusion 11 on the pawl 3 becomes adjacent on the stop 10.

If the catch 2 still maintains its closed position in this position according to the illustration in FIG. 1 because of ice or other flap obstruction, the pawl 3 is located in the storage position according to the illustration according to FIG. 3. In the storage position, the latch leg 8*a* is not engaged by the contour 12 on the catch 2.

Figure 4:
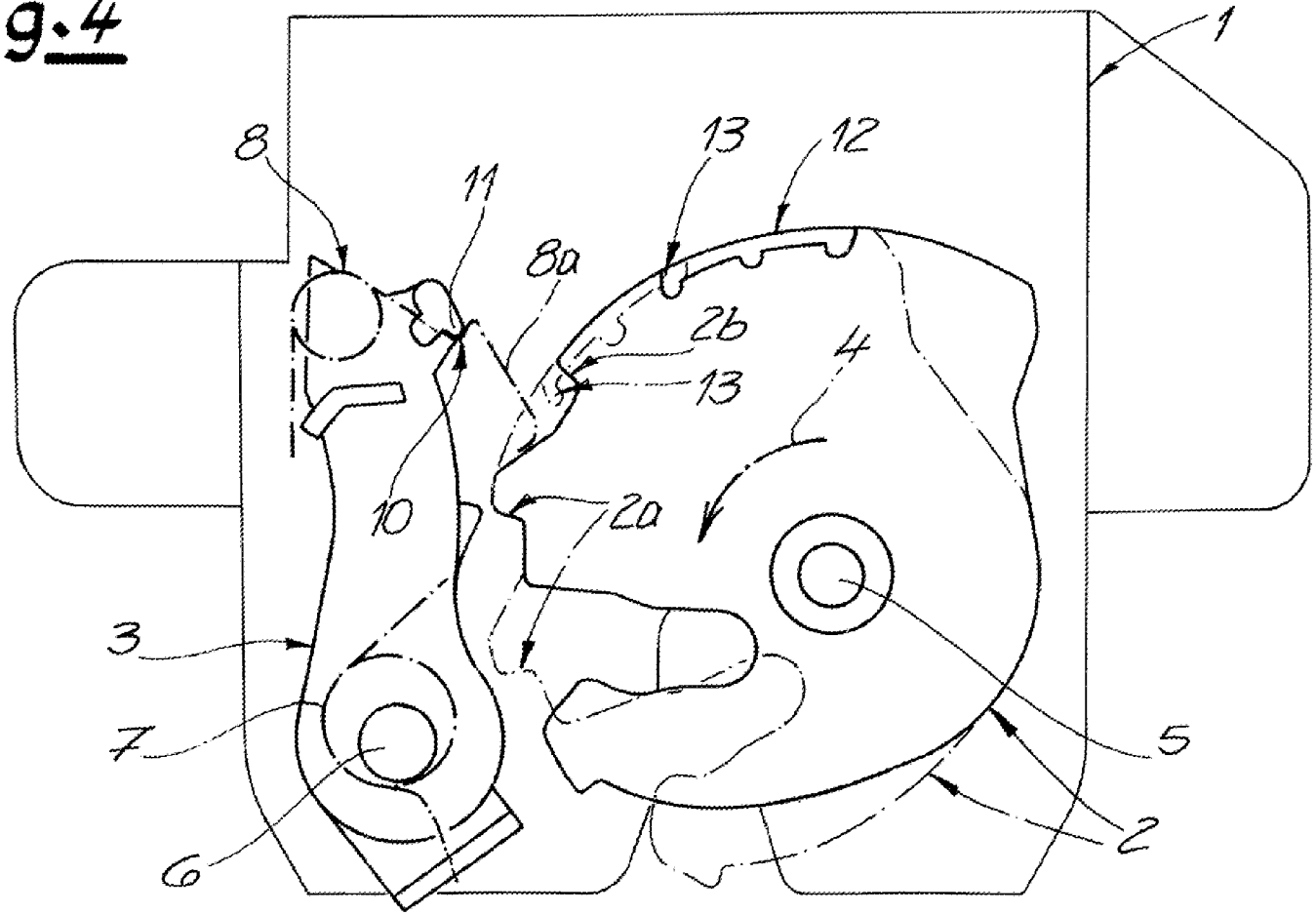

If now, starting from the storage position according to FIG. 3, any obstacle to the opening of the locking mechanism 2, 3 is removed, the catch 2 can open increasingly, namely by the catch spring 4 impinging the catch 2 in an anti-clockwise direction according to the arrow illustration in FIG. 4 around its axis or rotational axis 5. The catch 2 is equipped with a contour 12 to cancel the storage position.

The contour 12 is located on an edge of the catch 2 which faces the pawl 3. Furthermore, the contour 12 has a leading edge 13. The contour 12 in conjunction with the leading edge 13 formed from the contour 12 cancels the storage position of the pawl 3. For this purpose, the contour 12 and the leading edge 13 ensures that the stop 10 on the latch leg 8*a* of the leg spring 8 is elevated from the protrusion 11 on the pawl 3. This functional position is apparent in the transition from FIG. 4 to FIG. 5.

In fact, the opening catch 2 starting from the storage position according to FIG. 3 ensures that the latch leg 8*a* of the leg spring 8 previously located against the protrusion 11 is impinged by the leading edge 13 of the contour 12. Thus, the latch leg 8*a* of the leg spring 8 is moved in the direction of the stationary held leg 8*b* of the leg spring 8. This is apparent in a comparison of both functional positions according to FIGS. 4 and 5. As a result, the stop 10 in or on the latch leg 8*a* is simultaneously moved away from the protrusion 11 on the pawl 3. Consequently, the protrusion 11 on the pawl 3 is free from the stop 10 in the illustration according to FIG. 5. The latch leg 8*a* glides along the contour 12 of the catch 2 and can consequently no longer interact with the pawl 3 because the opening catch 2 with its contour 12 has engaged the latch leg 8*a*. In the same way, the pawl 3 glides along the external edge of the catch 2 because it is beyond any ratchet recesses 2*a*, 2*b*. The catch 2 is now completely opened as illustrated in FIG. 5.

Figure 5:
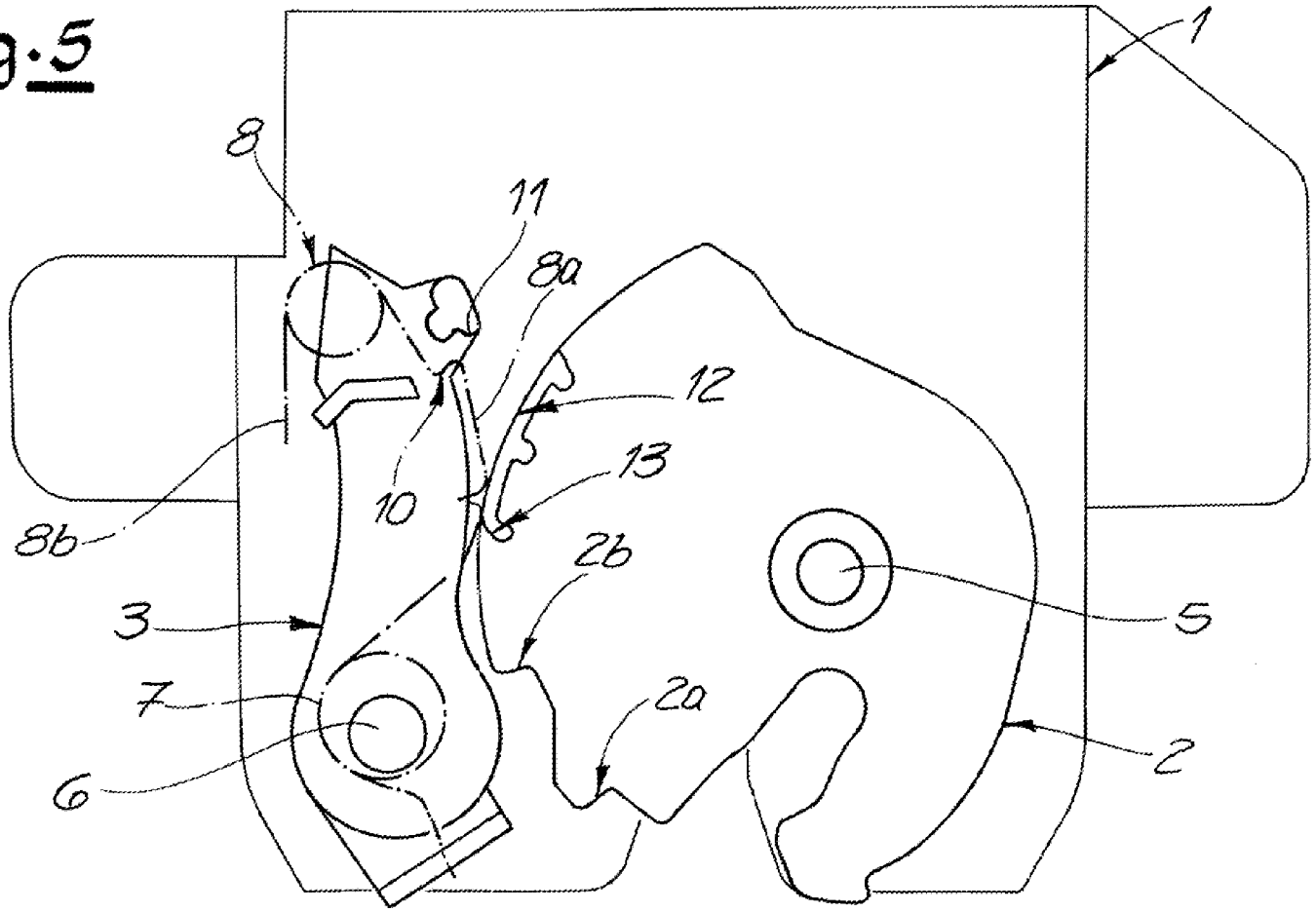
Figure 6:
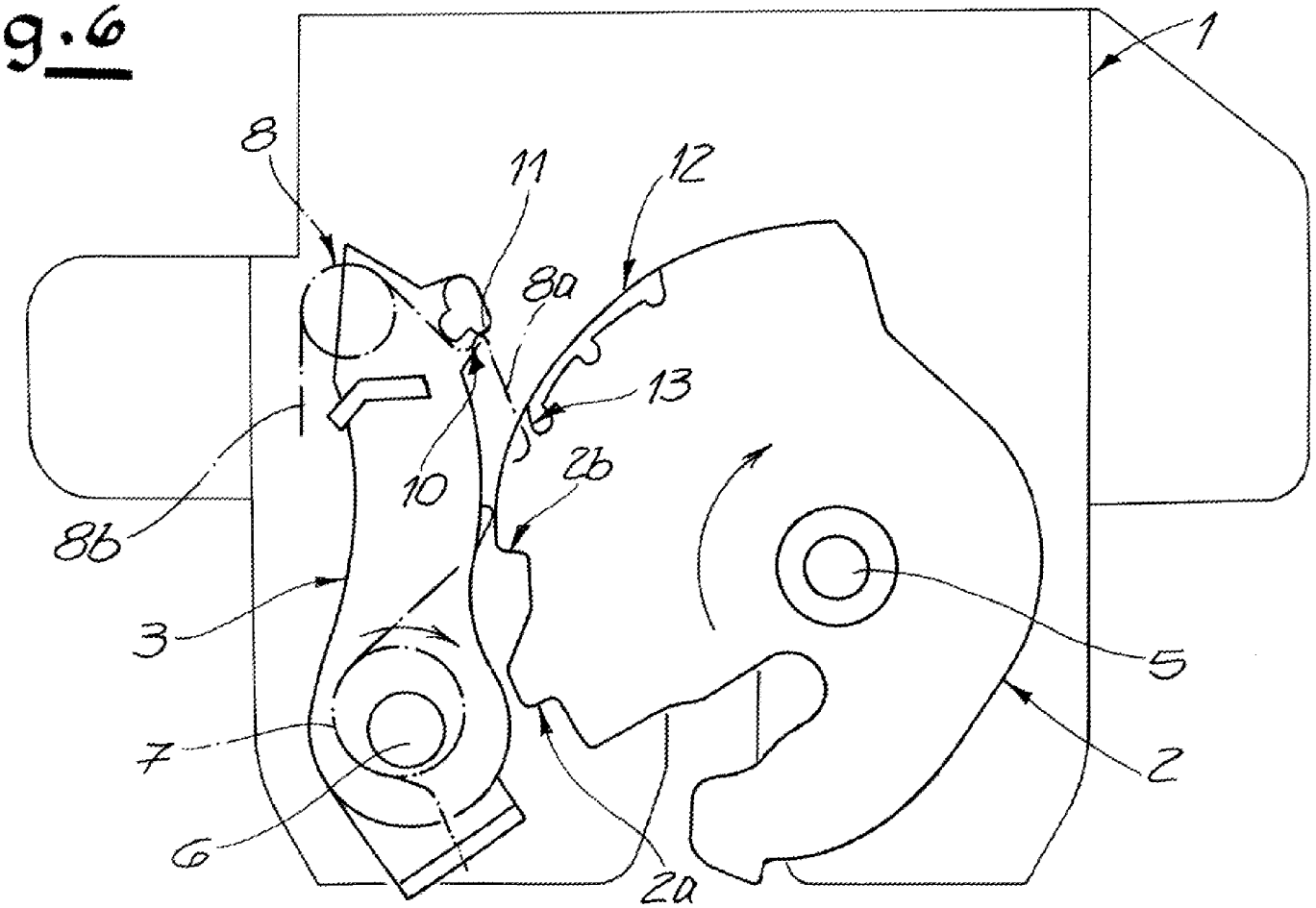

If now, starting from the open position according to FIG. 5, the locking mechanism 2, 3 is closed, this closure process according to the illustration according to FIG. 6 corresponds to the catch 2 being pivoted in an anti-clockwise direction around its axis or rotational axis 5, as depicted by a relevant arrow in FIG. 6. This pivoting movement in the clockwise direction by the catch 2 is thus initiated or triggered by a not explicitly depicted locking bolt engaging into the catch 2 and impinging during closure of the motor vehicle door latch in the closure movement depicted by the arrow in a clockwise direction around the axis 5. After completion of a certain pivoting course of the catch 2 in the illustrated clockwise direction according to FIG. 6, the pawl 3 assisted by its pawl spring 7 initially engages into the pre-ratchet recess 2*b* and subsequently into the main ratchet recess 2*a* until the main ratchet position or closure position is (re) attained according to FIG. 1. Throughout this closing process the pawl 3 impinged by its spring 7 towards the catch 2 is not elevated sufficiently for the pawl protrusion 11 to engage the spring stop 10.

The invention claimed is:

1. A motor vehicle door latch comprising:

a locking mechanism having a catch moveable between a closed position and an open position, and a pawl that is engaged against the catch when in the closed position, wherein when the catch moves from the closed position toward the open position, the pawl is moveable toward an elevated storage position in which the pawl is disengaged from the catch; and a spring-impinged storage element which holds the pawl in the elevated storage position until the catch is fully moved to the open position, wherein the spring-impinged storage element is formed as a leg spring having a stationary leg which is anchored and held stationary in the latch, the leg spring having a latch leg that engages and braces the pawl to hold the pawl in the elevated storage position and is engageable by the catch to release the pawl from the latch leg.

2. The motor vehicle door latch according to claim 1, wherein the stationary leg and the latch leg have an acute angle therebetween, and the leg spring has a wound central section to which the stationary leg and the latch leg are connected.

3. The motor vehicle door latch according to claim 1, wherein the latch leg has a stop and the pawl engages against the stop when in the elevated storage position.

4. The motor vehicle door latch according to claim 3, wherein the pawl has a protrusion that engages the stop.

5. The motor vehicle door latch according to claim 3, wherein the stop is z-shaped.

6. The motor vehicle door latch according to claim 4, wherein the protrusion glides along the latch leg and overlaps the stop when the catch moves toward the open position.

7. The motor vehicle door latch according to claim 4, wherein the catch has a contour that lifts the stop on the latch leg from the protrusion of the pawl to release the pawl from the elevated storage position.

8. The motor vehicle door latch according to claim 1, wherein the catch has a contour that engages the latch leg to release the pawl from the latch leg.

9. The motor vehicle door latch according to claim 8, wherein the contour is arranged on the catch facing the pawl.

10. The motor vehicle door latch according to claim 8, wherein the contour has a leading edge that impinges the latch leg.

11. The motor vehicle door latch according to claim 1 further comprising a latch housing, wherein the stationary leg is braced against the latch housing.

12. The motor vehicle door latch according to claim 1, wherein the catch has a main ratchet recess and the pawl is engaged within the main ratchet recess when the catch is in the closed position.

13. The motor vehicle door latch according to claim 12, wherein the catch has a secondary recess within which the pawl is engageable.

14. The motor vehicle door latch according to claim 1, wherein the catch has a contour that engages the latch leg to release the pawl from the latch leg.

* * * * *